US007509691B1

(12) United States Patent
Wingate

(10) Patent No.: US 7,509,691 B1
(45) Date of Patent: Mar. 31, 2009

(54) HEAD SUPPORT SYSTEM

(76) Inventor: Kenneth E. Wingate, 67128 Greg Dyal Ct., Yulee, FL (US) 32097

( * ) Notice: Subject to any disclaimer, the term of this patent is extended or adjusted under 35 U.S.C. 154(b) by 461 days.

(21) Appl. No.: 11/217,792

(22) Filed: Sep. 2, 2005

(51) Int. Cl.
*A42B 7/00* (2006.01)

(52) U.S. Cl. ..... 2/421; 2/411

(58) Field of Classification Search ..... 2/421, 2/410, 411, 416, 425; 244/122 AG; 280/290
See application file for complete search history.

(56) References Cited

U.S. PATENT DOCUMENTS

| | | | | |
|---|---|---|---|---|
| D213,085 | S | 1/1969 | Wyckoff | |
| 4,664,341 | A | 5/1987 | Cummings | |
| 4,909,459 | A * | 3/1990 | Patterson | 244/122 AG |
| 4,923,147 | A * | 5/1990 | Adams et al. | 244/122 AG |
| 5,956,777 | A * | 9/1999 | Popovich | 2/424 |
| 6,009,566 | A | 1/2000 | Hubbard | |
| 6,378,140 | B1 * | 4/2002 | Abraham et al. | 2/411 |
| 6,381,758 | B1 * | 5/2002 | Roberts et al. | 2/421 |
| 6,428,043 | B1 * | 8/2002 | Wooten | 280/748 |
| 6,499,149 | B2 | 12/2002 | Ashline | |
| 6,619,751 | B1 | 9/2003 | Shah | |
| 6,931,669 | B2 * | 8/2005 | Ashline | 2/422 |
| 2003/0088906 | A1 * | 5/2003 | Baker | 2/416 |
| 2004/0194194 | A1 * | 10/2004 | McNeil et al. | 2/421 |
| 2004/0255368 | A1 * | 12/2004 | Baker | 2/410 |

* cited by examiner

*Primary Examiner*—Gary L Welch
*Assistant Examiner*—Andrew W Sutton

(57) ABSTRACT

A head support system includes a helmet that has an upper surface and a bottom edge. A strap has a pair of ends. Each of the ends is attached to the bottom edge so that the strap traverses an open bottom side of the helmet. A plurality of belts is provided. Each of the belts has a first end and a second end. Each of the second ends is attached to a bottom side of a vehicle roof. A coupling apparatus is attached to each of the first ends of the belts and to the helmet to suspend the helmet from the roof. The helmet may be positioned on a person's head to prevent excessive vertical movement of the person's head.

13 Claims, 6 Drawing Sheets

HEAD SUPPORT SYSTEM

BACKGROUND OF THE INVENTION

1. Field of the Invention

The present invention relates to head supporting devices and more particularly pertains to a new head supporting device for supporting a head within a vehicle to prevent neck injuries while a person is driving over uneven surfaces.

2. Description of the Prior Art

The use of head supporting devices is known in the prior art. U.S. Pat. No. 6,381,758 describes a head restraint device for use by a racecar driver that includes a helmet and a pair of resiliently flexible tethers attached thereto. Another type of head supporting device is U.S. Pat. No. 4,664,341 having a helmet and a band attached thereto which secures the helmet to a headrest of a seat. Still yet another such device is found in U.S. Pat. No. 6,619,751 that has a tether assembly that is attachable to headgear worn by a person and which prevents a person's head from moving forward during an accident.

While these devices fulfill their respective, particular objectives and requirements, the need remains for a device which supports a head during vertical and lateral movement as opposed to only lateral movement. This will prevent injuries not only from car accidents but also from excessive vertical movement which can be found during traveling on uneven road surfaces. In particular, support in a vertical direction will prevent compression injuries to neck and back vertebrae.

SUMMARY OF THE INVENTION

The present invention meets the needs presented above by comprising a helmet that has an upper surface and a bottom edge. A strap has a pair of ends. Each of the ends is attached to the bottom edge so that the strap traverses an open bottom side of the helmet. A plurality of belts is provided. Each of the belts has a first end and a second end. Each of the second ends is attached to a bottom side of a vehicle roof. A coupling apparatus is attached to each of the first ends of the belts and to the helmet to suspend the helmet from the roof. The helmet may be positioned on a person's head to prevent excessive vertical movement of the person's head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
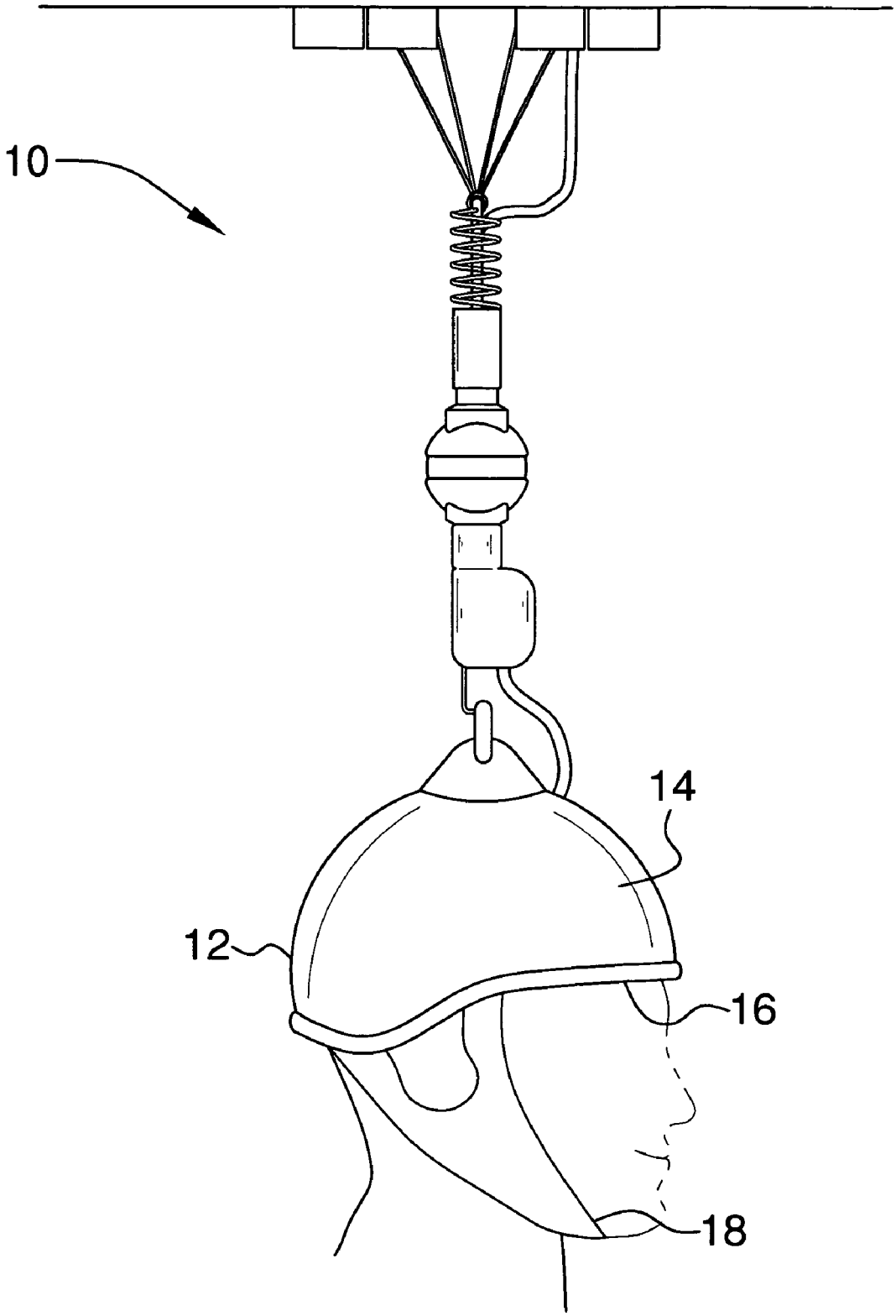
FIG. 1 is a side view of a head support system according to the present invention.

With reference now to the drawings, and in particular to FIGS. 1 through 6 thereof, a new head supporting device embodying the principles and concepts of the present invention and generally designated by the reference numeral 10 will be described.

Figure 2:
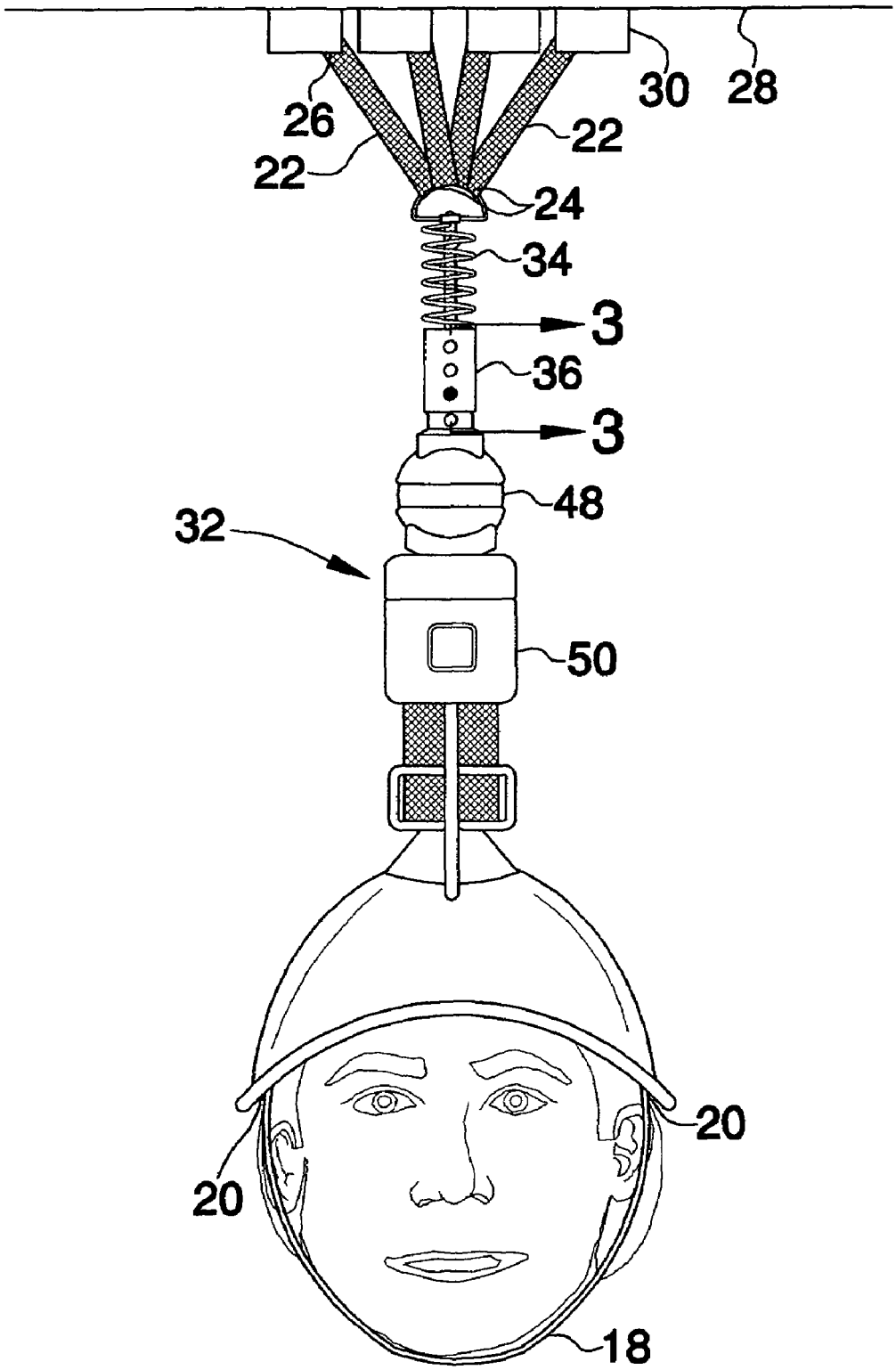
FIG. 2 is a front view of the present invention.
Figure 3:
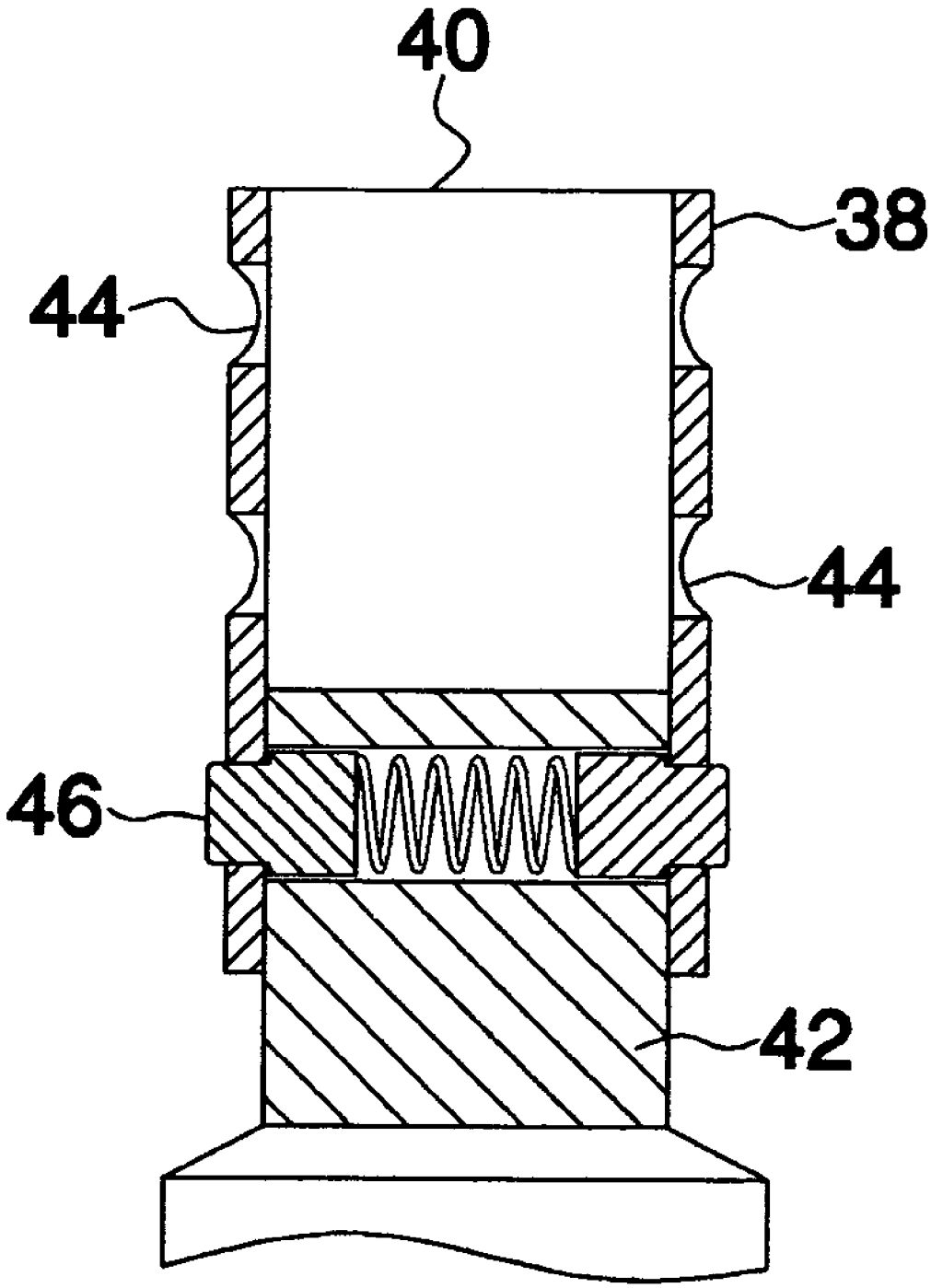
FIG. 3 is a cross-sectional view taken along line 3-3 of FIG. 2 of the present invention.
Figure 4:
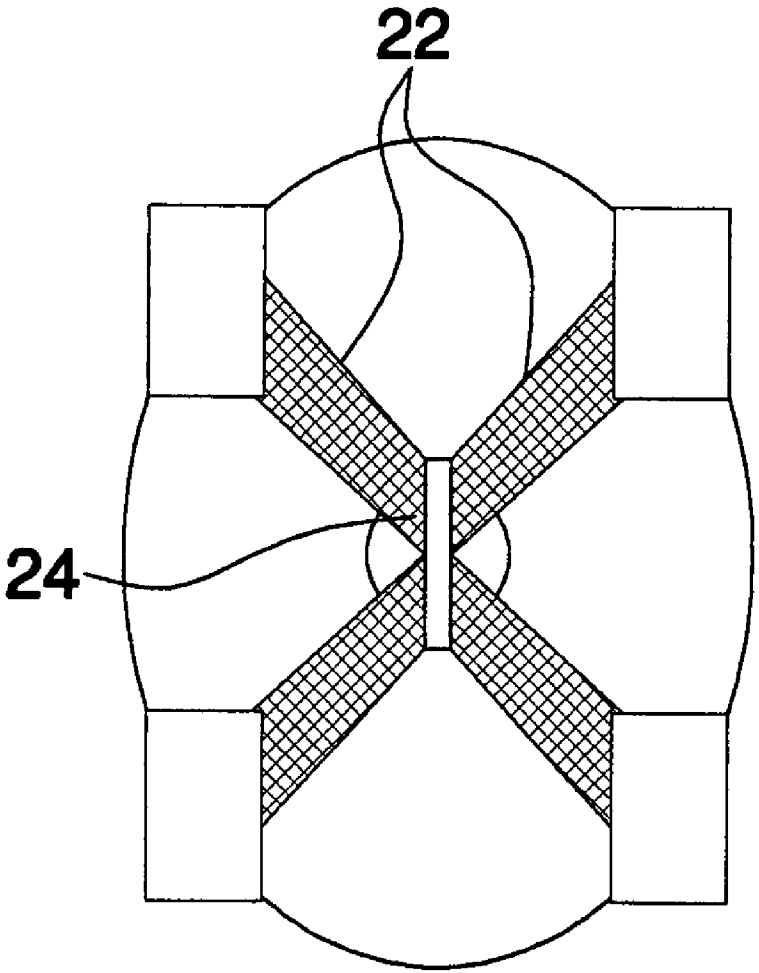
FIG. 4 is a top view of the present invention.
Figure 5:
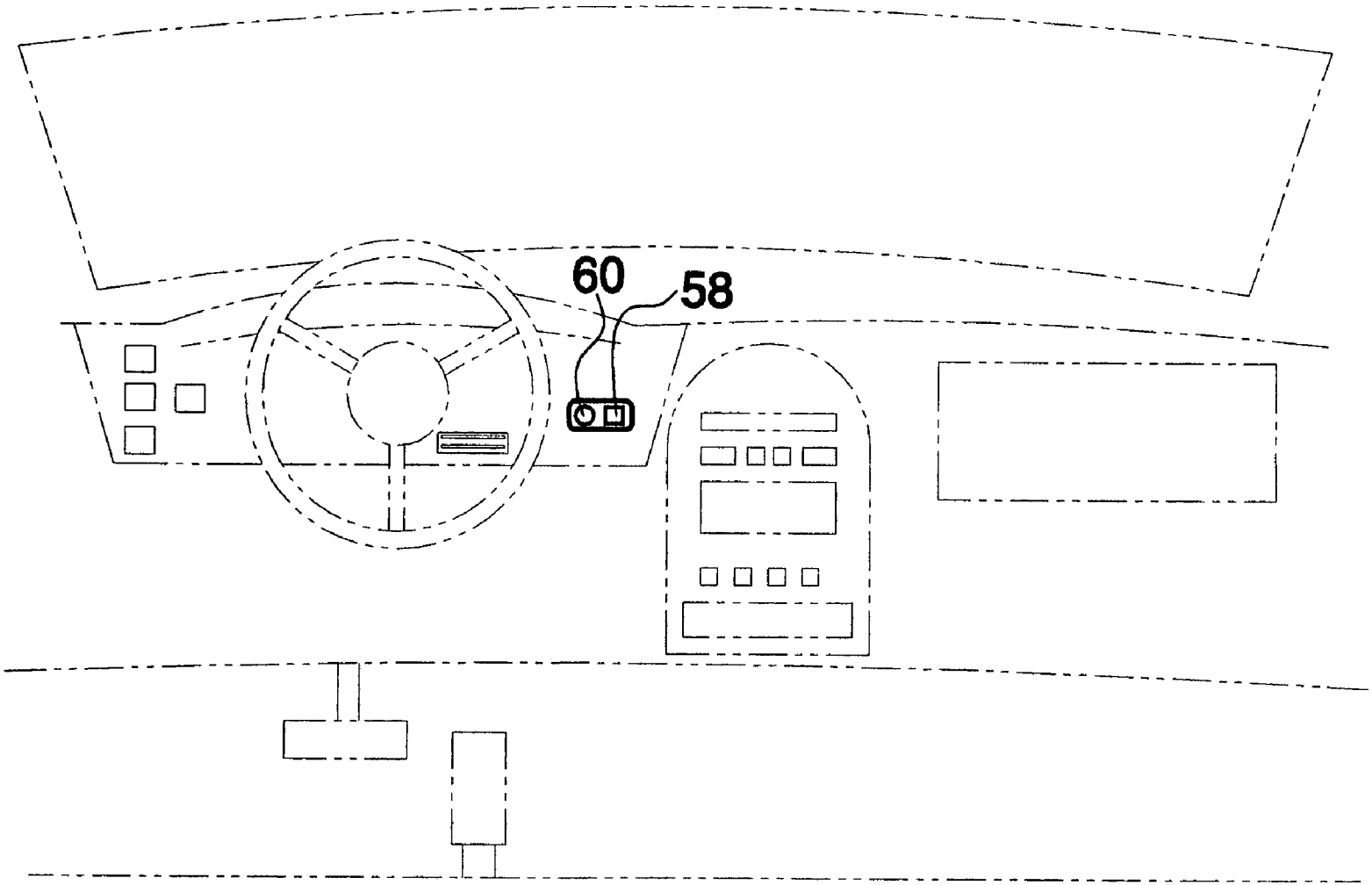
FIG. 5 is a front view of a dashboard of a vehicle of the present invention.
Figure 6:
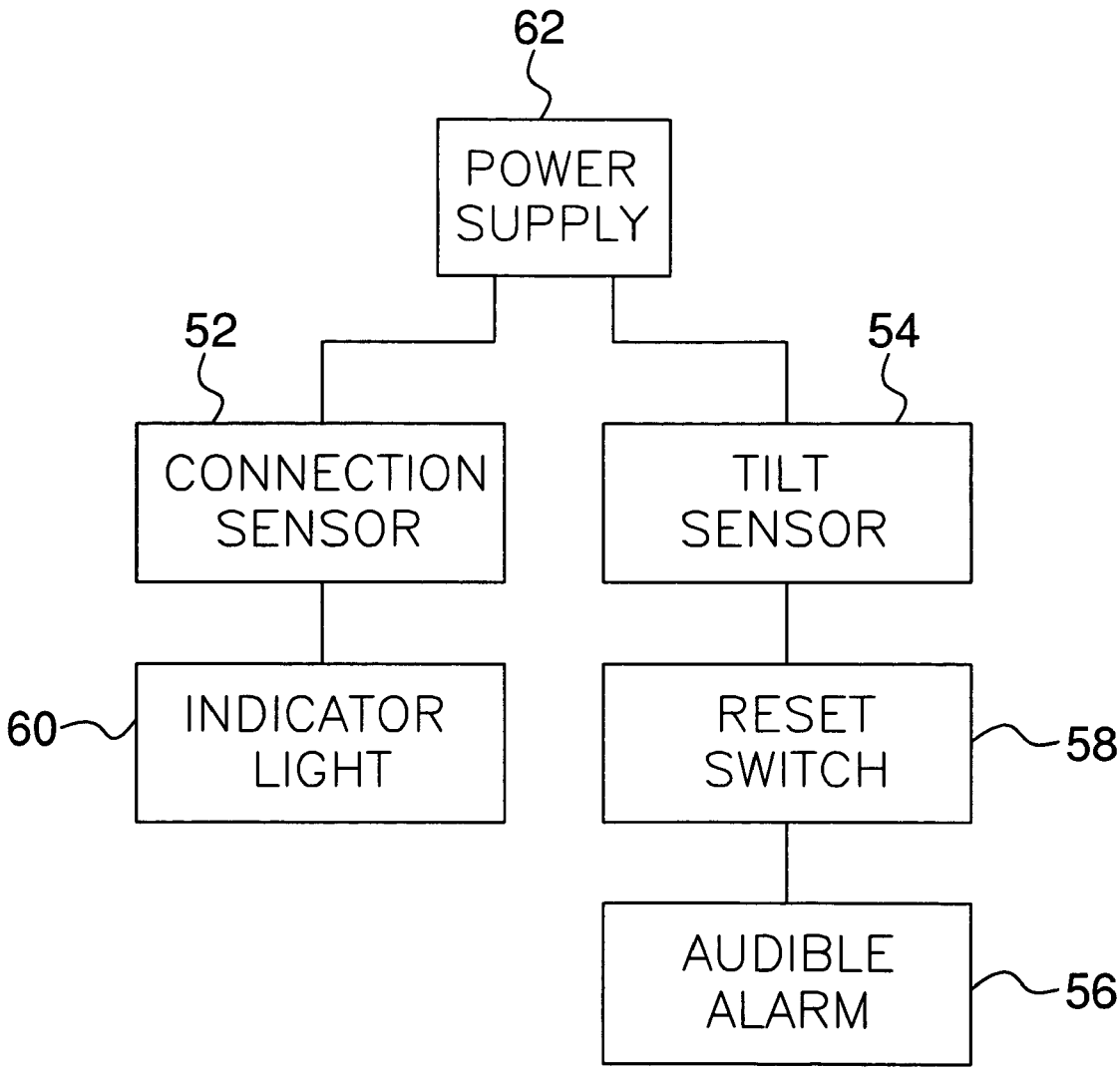
FIG. 6 is an electronic schematic view of the present invention.

As best illustrated in FIGS. 1 through 6, the head support system 10 generally comprises a helmet 12 that has an upper surface 14 and a bottom edge 16. A strap 18 has a pair of ends 20. Each of the ends 20 is attached to the bottom edge 16 so that the strap 18 traverses an open bottom side of the helmet 12. The strap 18 is used for securing a person's head in the helmet 12 as shown in FIG. 2.

A plurality of belts 22 is provided. Each of the belts 22 has a first end 24 and a second end 26. Each of the second ends 26 is attached to a bottom side of a vehicle roof 28. The vehicle roof 28 may be any vehicle roof but will generally be a truck cab for those trucks used on generally rough terrain. The second ends 26 may be retractable into housings 30 that include conventional inertia roller locks, which locks their position upon sudden movements.

A coupling apparatus 32 is attached to each of the first ends 24 of the belts 22 and to the helmet 12. The coupling apparatus 32 suspends the helmet 12 from the roof 28. The coupling apparatus 32 includes a biasing member 34 that biases the helmet 12 toward the belts 22. The biasing member 34 is attached to the first ends 24 of the belts 22. The biasing member 34 comprises a spring. A length adjusting member 36 is configured to allow selective adjustment of a length of the coupling apparatus 32. The length adjusting member 36 includes a cylinder 38 that has a top end 40 attached to the biasing member 34. A rod 42 is positioned in and is selectively extendable outwardly of a bottom end of the cylinder 38. The cylinder 38 has a plurality of apertures 44 therein. A pin 46 is removably extendable through the rod 42 and through one of the apertures 44. A swivel 48 for allowing rotation of helmet 12 with respect to the belts 22 is attached to the rod 42. A release assembly 50 is configured to selectively release the belts 20 from the helmet 12. The release assembly 50 is positioned between the swivel 48 and the helmet 12. The release assembly 50 preferably includes male and female buckle members.

The coupling apparatus 32 may include a connection sensor 52 of the type typically used in seat belts to signal that the coupling apparatus 50 is engaged. This in turn may send a wireless signal to a monitoring station which may monitor the usage of the system 10. A tilt sensor 54 may be mounted in the helmet 12 for determining when the helmet 12 is tilting excessively. Such tilting may be indicative of a driver falling asleep. The tilt sensor 54 is preferably electrically coupled to an audible alarm 56 which emits a sound when the helmet 12 is excessively tilted, such as at an angle greater than 15 degrees with respect to a vertical axis. A reset switch 58 and an activation light 60 may each be mounted on a dashboard of the vehicle 10 to reset the alarm 56 and to indicate that the helmet 10 is connected to the straps 22. The tilt 54 and connection 52 sensors are electrically coupled to a power supply 62 of the vehicle.

In use, the helmet 12 may be positioned on a person's head to prevent excessive vertical movement of the person's head. This is of particular importance to those drivers working on worksites where the ground is uneven. The coupling apparatus 32 retains the head of the user of the system 10 in a generally upright position and the biasing member 34 absorbs and cushions impacts.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A head support system for a person operating a vehicle, said system comprising:

a helmet having an upper surface and a bottom edge, a strap having a pair of ends, each of said ends being attached to said bottom edge such that said strap traverses an open bottom side of the helmet;

a plurality of belts, each of said belts having a first end and a second end, each of said second ends being attached to a bottom side of a vehicle roof;

a coupling apparatus being attached to each of said first ends of said belts and to said helmet and suspending said helmet from the roof;

said coupling apparatus includes a biasing member biasing said helmet toward said belts, said biasing member being attached to said first ends of said belts;

a connection sensor signaling when said coupling apparatus is engaged, a monitoring station receiving a wireless signal from said connection sensor and monitoring engagement of said coupling apparatus; and wherein said helmet may be positioned on a person's head to prevent excessive vertical movement of the person's head.

2. The system according to claim 1, wherein said biasing member comprises a spring.

3. The system according to claim 1, wherein said coupling apparatus further includes a length adjusting member configured to allow selective adjustment of a length of said coupling apparatus.

4. The system according to claim 3, wherein said length adjusting member includes a cylinder having a top end attached to said biasing member, a rod being positioned in and being selectively extendable outwardly of a bottom end of said cylinder, said cylinder having a plurality of apertures therein, a pin being removably extendable through said rod and through one of said apertures.

5. The system according to claim 1, wherein said coupling apparatus further includes a swivel for allowing rotation of helmet with respect to said belts.

6. The system according to claim 4, wherein said coupling apparatus further includes a swivel for allowing rotation of helmet with respect to said belts.

7. The system according to claim 6, wherein said swivel is attached to said rod.

8. The system according to claim 6, wherein said coupling apparatus further includes a release assembly configured to selectively release said belts from said helmet, said release assembly being positioned between said swivel and said helmet.

9. The system according to claim 1, wherein said coupling apparatus further includes a release assembly configured to selectively release said belts from said helmet.

10. A head support system for a person operating a vehicle, said system comprising:

a helmet having an upper surface and a bottom edge, a strap having a pair of ends, each of said ends being attached to said bottom edge such that said strap traverses an open bottom side of the helmet;

a plurality of belts, each of said belts having a first end and a second end, each of said second ends being attached to a bottom side of a vehicle roof;

a coupling apparatus being attached to each of said first ends of said belts and to said helmet and suspending said helmet from the roof, said coupling apparatus including:

a biasing member biasing said helmet toward said belts, said biasing member being attached to said first ends of said belts, said biasing member comprising a spring;

a length adjusting member configured to allow selective adjustment of a length of said coupling apparatus, said length adjusting member including a cylinder having a top end attached to said biasing member, a rod being positioned in and being selectively extendable outwardly of a bottom end of said cylinder, said cylinder having a plurality of apertures therein, a pin being removably extendable through said rod and through one of said apertures;

a swivel for allowing rotation of helmet with respect to said belts, said swivel being attached to said rod;

a release assembly configured to selectively release said belts from said helmet, said release assembly being positioned between said swivel and said helmet;

a connection sensor signaling when said coupling apparatus is engaged, a monitoring station receiving a wireless signal from said connection sensor and monitoring engagement of said coupling apparatus; and wherein said helmet may be positioned on a person's head to prevent excessive vertical movement of the person's head.

11. The system according to claim 1, further including a tilt sensor being mounted in said helmet and determining excessive tilting of said helmet, said excessive tilting being greater than 15 degrees with respect to a vertical axis, an audible alarm being electrically coupled to said tilt sensor, said audible alarm emitting a sound when said helmet is excessively tilted.

12. The system according to claim 10, further including a tilt sensor being mounted in said helmet and determining excessive tilting of said helmet, said excessive tilting being greater than 15 degrees with respect to a vertical axis, an audible alarm being electrically coupled to said tilt sensor, said audible alarm emitting a sound when said helmet is excessively tilted.

13. A head support system for a person operating a vehicle, said system comprising:

a helmet having an upper surface and a bottom edge, a strap having a pair of ends, each of said ends being attached to said bottom edge such that said strap traverses an open bottom side of the helmet;

a plurality of belts, each of said belts having a first end and a second end, each of said second ends being attached to a bottom side of a vehicle roof;

a coupling apparatus being attached to each of said first ends of said belts and to said helmet and suspending said helmet from the roof;

said coupling apparatus includes a biasing member biasing said helmet toward said belts, said biasing member being attached to said first ends of said belts;

a tilt sensor being mounted in said helmet and determining excessive tilting of said helmet, said excessive tilting being greater than 15 degrees with respect to a vertical axis, an audible alarm being electrically coupled to said tilt sensor, said audible alarm emitting a sound when said helmet is excessively tilted; and wherein said helmet may be positioned on a person's head to prevent excessive vertical movement of the person's head.

* * * * *